US007494096B2

(12) United States Patent
Paloian et al.

(10) Patent No.: US 7,494,096 B2
(45) Date of Patent: Feb. 24, 2009

(54) BAG OPENING SUPPORT METHOD AND DEVICE

(76) Inventors: Michael Paloian, 427 Woodbury Rd., Cold Spring Harbor, NY (US) 11724; Andrea Paloian, 427 Woodbury Rd., Cold Spring Harbor, NY (US) 11724

( * ) Notice: Subject to any disclaimer, the term of this patent is extended or adjusted under 35 U.S.C. 154(b) by 155 days.

(21) Appl. No.: 10/983,099

(22) Filed: Nov. 4, 2004

(65) Prior Publication Data

US 2006/0091267 A1 May 4, 2006

(51) Int. Cl.
*B65B 67/04* (2006.01)

(52) U.S. Cl. ..... 248/99; 248/95; 141/391

(58) Field of Classification Search ..... 248/95, 248/97, 99, 152, 100, 101; 141/390, 391, 141/392; 220/495.08
See application file for complete search history.

(56) References Cited

U.S. PATENT DOCUMENTS

| | | | | |
|---|---|---|---|---|
| 1,097,701 | A | | 5/1914 | Yount |
| 3,893,649 | A | | 7/1975 | Comell et al. |
| 4,037,778 | A | * | 7/1977 | Boyle ..... 141/390 |
| 4,270,788 | A | | 6/1981 | Overholt |
| 4,287,701 | A | | 9/1981 | Washington |
| 4,482,116 | A | | 11/1984 | Vadnais |
| 4,521,043 | A | * | 6/1985 | Wilsford ..... 294/1.1 |
| 4,543,691 | A | | 10/1985 | Calmettes |
| 4,664,348 | A | * | 5/1987 | Corsaut et al. ..... 248/99 |
| 4,749,011 | A | | 6/1988 | Rylander |
| 4,759,519 | A | | 7/1988 | Cheng |
| 4,805,858 | A | | 2/1989 | Taylor |
| 4,815,866 | A | | 3/1989 | Martone |
| 4,832,292 | A | | 5/1989 | Beckham |
| 4,848,709 | A | | 7/1989 | Kiniry |
| 4,884,603 | A | * | 12/1989 | Simpson ..... 141/390 |
| 5,014,943 | A | * | 5/1991 | Nelson et al. ..... 248/99 |
| 5,050,920 | A | | 9/1991 | Potticary |
| 5,082,219 | A | | 1/1992 | Blair |
| 5,106,041 | A | | 4/1992 | Jelincic |
| 5,129,609 | A | | 7/1992 | Tobin |
| 5,149,028 | A | | 9/1992 | Blackaby et al. |
| 5,222,536 | A | | 6/1993 | Hodgdon et al. |
| 5,292,093 | A | | 3/1994 | Shumake |
| 5,413,394 | A | | 5/1995 | Mitchell |
| D361,185 | S | | 8/1995 | Seiler et al. |
| 5,570,862 | A | | 11/1996 | Nugent |
| 5,588,622 | A | | 12/1996 | Gordon, Sr. |

(Continued)

*Primary Examiner*—Amy J. Sterling
*Assistant Examiner*—Tan Le
(74) *Attorney, Agent, or Firm*—Wechsler & Wechsler, P.C.; Lawrence I. Wechsler

(57) ABSTRACT

A method of maintaining an open-mouth state of a bag utilizes a device of suitable form retainable at or adjacent to a bag opening. The device includes an elongated dimensional component extending between respective opposed free ends and which device can assume a shape in the elongated dimension defining a non-linear path along which a circumference of the bag can be made to follow. A length of the non-linear path is greater than half of the circumference of the bag opening and less than the circumference, such that a circumferential segment portion of the bag is held in a position roughly corresponding to the non-linear path and a remainder of the bag circumference extends in an unsupported manner between the free ends of the device, spaced apart from the portion thereof guided along the non-linear path.

13 Claims, 11 Drawing Sheets

U.S. PATENT DOCUMENTS 5,615,853 A 4/1997 Hearst
5,641,138 A 6/1997 Cronk et al.
5,857,722 A * 1/1999 Ayotte ..... 294/1.1
5,913,496 A 6/1999 Valdez
6,045,263 A 4/2000 Keller et al.
6,155,521 A 12/2000 O'Hanlon
6,237,878 B1 5/2001 Nelson
6,279,975 B1 8/2001 Gamliel
6,296,212 B1 * 10/2001 Monahan ..... 248/99
6,450,461 B1 9/2002 Lohmann
6,520,554 B2 2/2003 Ditzik
6,536,488 B1 3/2003 Pochobradsky
2001/0032911 A1 10/2001 Gabl

* cited by examiner

BAG OPENING SUPPORT METHOD AND DEVICE

BACKGROUND OF THE INVENTION

The present invention relates to a method of holding open a mouth of a bag, more particularly a refuse bag, in a manner facilitating the filling thereof with material, including, for example, leaves, grass, debris or the like, and a device for implementing same.

Large capacity plastic bags, such as lawn or refuse bags, are widely used for collecting and discarding raked leaves, grass trimmings, and other lawn and/or construction debris. However, due to the flexible nature of such bags, it is difficult, if not impossible, for a user working alone, to hold the mouth of the bag open and simultaneously rake leaves or debris into the bag. The often cumbersome size of these bags can further exacerbate the difficulty encountered. In addition, attempts to fill the bag while oriented in an upright position are similarly made difficult, as the bag, by itself, does not retain an open disposition without suitable supplemental support.

While various devices have been suggested to maintain the mouth of a refuse bag in an open condition and in a shape suited for transfer of lawn debris and the like to an interior thereof, such devices generally have included a structural shape, a portion of which is defined by an arcuate support part to which the mouth of the bag is fitted and secured by various measures. These devices, while providing effective solutions to the aforementioned problems attendant filling of a lawn or refuse bag by a single user, all have generally relied upon some form of fully encircling frame structure, and which often have required multiple independent parts to maintain such arcuate form over a circumferential portion thereof. Since such fully encircling form is generally of a prescribed diameter, these devices have not been easily adapted to use with bags different sizes having a varying range of mouth sizes. Moreover, while being suitable for use either with a bag resting on the ground oriented with the mouth opening thereof facing sideways or one oriented in an upright position with the opening thereof upwardly facing, a bag support device of particular conventional design has not heretofore been generally suited to both use options.

It would therefore be desirable to provide a simple, reliable and versatile method of loading a bag, particularly a lawn refuse bag, and a device for implementing the method having a form which is easily and economically constructed, simple and versatile to use, and which can be easily stored between use in a compact and space-efficient manner.

Accordingly, it is an object of the invention to provide a method and device for securing a mouth of a refuse bag in an open condition which overcome the drawbacks of the prior art.

It is a further object of the invention to provide a method and device by which an the mouth of a refuse bag may be held open and removably secured to a horizontal and/or vertical support, such as the ground and/or upright member, respectively, whereby hands-free loading of the refuse bag by a single user is facilitated, and which may be implemented by a device of physical form which is economical, easy to use and which is adaptable to use independent of moderate variations in bag size.

SUMMARY OF THE INVENTION

In accordance with these and other objects of the invention, there is provided a method of maintaining an open-mouth state of a bag, and for filling thereof, which utilizes a device of suitable form advantageously retainable at or adjacent to the bag opening.

Broadly stated, the method according to an embodiment of the invention includes guiding a major portion of a circumference of a bag (i.e., greater than half of the total circumference), and which is advantageously located proximate the bag opening, along a supported non-linear path provided in such manner as to form a gap between the supported portion and a remaining portion extending, advantageously, in a substantially unsupported manner between ends of the supported portion, via which refuse can be introduced into the bag.

An embodiment of a device used to implement the method in accordance with the invention utilizes a structural form including an elongated dimensional component extending between respective opposed free ends, and which device can assume a shape in the elongated dimension defining a non-linear path, over at least a portion thereof, along which the circumference of the bag can be made to follow. In accordance with this embodiment, an overall length of the device measured from end to end, including the non-linear path, is greater than half of the circumference of the bag opening, such that a circumferential segment portion of the bag is supportably held in a position roughly corresponding to a shape defined by at least a portion of the elongated dimension of the device, including the non-linear path, and a remainder of the bag circumference, which is less than half the circumference, extends in an unsupported manner between the free ends of the device, spaced apart from the portion of the bag circumference supportably guided along the non-linear path, thereby defining a gap between the portion of the bag guidably following the non-linear path of the device and the remaining portion of the bag extending unsupported between the free ends of the device. The bag is thereby held open to allow raked leaves and other refuse to be readily introduced into the bag through the gap. All, or a structural portion, of the device either permanently assumes the shape defining the non-linear path, or a shape thereof is selectively alterable by bending, folding or other reorganization or deformation to assume the desired shape affording the non-linear path during use, which achieves the objective of the invention.

In accordance with a further embodiment of the invention, the device advantageously comprises a member of elongated dimension having a length which is greater that half the circumference of the bag (i.e., the length of the member is larger than a width of the bag when the latter is in a flattened state) and less than the total circumference of the bag, and which member is flexible over at least a portion of the overall length thereof. An embodiment of the method according to the invention is carried out by inserting the flexible, elongated member into the opening of the bag, and bending the member lengthwise into an arcuate shape along which the interior circumferential region of the bag adjacent an opening edge of the mouth of the bag is made to follow. Advantageously, the flexible member exhibits moderately resilient characteristics over at least a length portion thereof, such that when an applied bending force is released after fitting a circumferential portion of the interior of the bag opening to the flexible member, the tensioned flexible member is resiliently secured against an interior circumferential region inwardly adjacent an opening edge of the mouth of the bag. Since the elongated member extends over more that half of the total circumference of the bag, the member retains a curved state without the need for providing secondary support structure, and the flexible member is prevented from returning to a flattened state until removed from the bag following its use.

In accordance with a particularly advantageous embodiment of the invention directed to a method of maintaining an open-mouth state of a bag, a first end of a flexible member having at least some degree of resilient properties is inserted into the mouth of the refuse bag, and flexed into an arcuate shape. While maintaining a flexed (arched) condition of the member, the corresponding portion of the interior circumference of the bag is then made, by the user, to conformably follow the arcuate length of the flexible member by guiding a correspondingly positioned segment of the interior of the mouth of the bag (or a region adjacent thereto), on the convex side of the flexed member, from its point of contact with the first end of the member, along its curved length, to a second end of the flexible member which is ultimately made to abut a point along the interior circumferential region of the bag distant from the point of contact thereof with the first end, and advantageously exerts outward pressure thereagainst by virtue of its resiliently flexed state. Since the flexible member, when formed into an arc-shape, traverses more that half the circumference of the bag opening, the inner dimensions of the bag prevent straightening of the flexible member to its original flattened shape. When the flexible member is advantageously made of a resilient material having moderate memory characteristics tending to return to an original shape when applied stress is relieved, the attendant outwardly directed resilient spring pressure exerted against the interior of the bag by the bent flexible member is alone sufficient to fix the flexible member to the bag and to thereby maintain the arcuate shape of the flexible member. A remaining portion of the interior circumference of the bag (which is less than half of the overall bag circumference) is maintained in a tensioned condition, extending substantially in a straight path running between the respective points of contact thereof with the first and second ends of the flexible member. The degree of curvature of the arc formed by the flexible member and the gap size between the free ends of the flexible member, which collectively define the mouth opening (aforementioned "gap") through which the leaves or refuse may be transferred to the interior of the bag, is a function of the length of the flexible member and the circumference of the bag being used. However, it will be understood that as long as the length of the flexible member is less than the bag circumference and greater than half of the circumference, the bag will be maintained in an open state when the flexible member is received in the bag according to the method of the invention. Thus, it will be understood that a flexible member of particular dimension will be suitable for use within a given range of various different bag circumferences.

In accordance with a further advantageous feature of the invention directed to the device, the flexibly resilient member is of generally flattened or planar shape when not in use, thereby minimizing required storage space, thus permitting the flexible member to stand upright against a wall or other vertical support, or to be hung from a peg or the like when not in use, as desired.

Since the flexing force generated by bending the flexible member is the greatest in the middle of the flexible member, the flexible member is, in accordance with an advantageous embodiment of the invention, constructed such that flexibility increases from the middle thereof to each of the opposed first and second ends, whereby the member attains an arcuate shape more closely approximating a uniform curve when flexed. This is conveniently, although not necessarily, achieved by providing flanges orthogonal to a widened dimension of the flexible member, which extend along at least a length portion of the flexible member, which have a height that increases as the middle of the member is approached from either end.

In accordance with a further advantageous embodiment, the flexible member includes widened end portions which facilitate installation thereof to the interior of the bag while in a flexed and tensioned state. The widened end portions further serve to spread transfer the spring forces to the bag at each of the opposed ends over a greater area to reduce likelihood of excessive stretched deformation of the bag. Still further, by providing the end portions with relative enlarged width, when the bag, together with the installed support, is placed on the ground with the mouth of the bag in a side-facing orientation, the arcuately flexed member is maintained in an upright orientation by virtue of stabilized ground support.

In accordance with a further advantageous embodiment of the invention, the device for implementing the method disclosed herein and a bag particularly suited for use with such device are provided in combination. In commercial practice, it is contemplated that the combination of the bag and holding device can thus be supplied to a consumer at time of purchase for later mutual use at a time and place as desired. Advantageously, such bag support device, constructed in accordance with the guidelines as generally described herein, could be supplied for each of a plurality of bags, and which combination presumably would be intended for one-time use with the particular bag being filled, such that once filled, the bag, along with the device, would be disposed of together.

Various embodiments of a device for implementing the method in accordance with the invention can assume a variety of different forms, either providing an angular non-linear path or an arcuate non-linear path along which the circumference of the bag is guided.

Still further advantageous embodiments of the device for maintaining an open mouth state of the bag are provided in various forms which are collapsible from a use condition to a storage state or reduced size, by telescoped, hinged, pivoted or other suitable structure providing like function and advantage.

The above, and other objects, features and advantages of the present invention will become apparent from the following description read in conjunction with the accompanying drawings.

DETAILED DESCRIPTION OF THE PREFERRED EMBODIMENT

Figure 1:
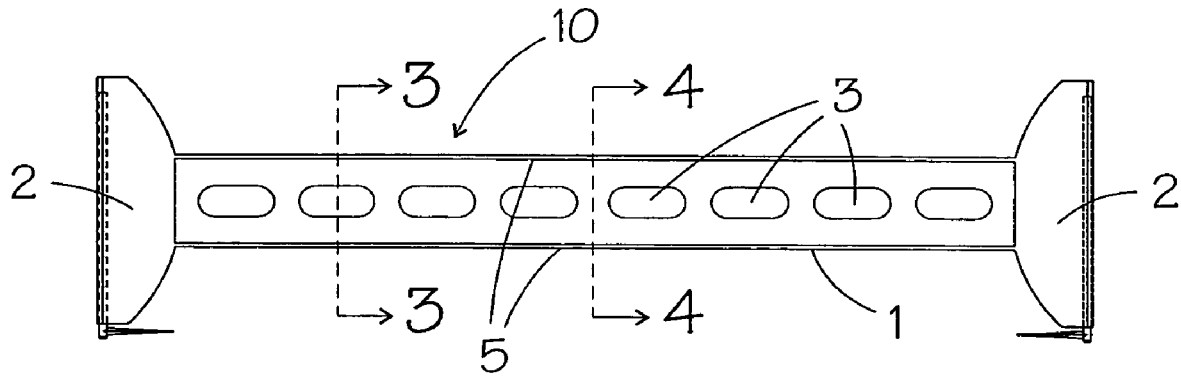
FIG. 1 is a plan view of a flexible bag support member in accordance with an embodiment of the invention.
Figure 2:
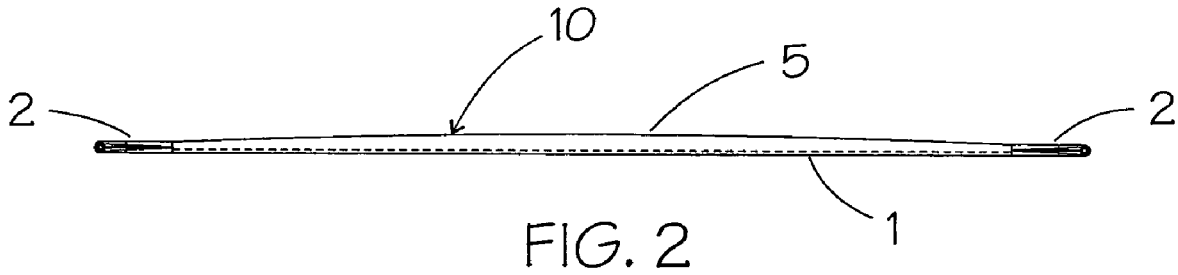
FIG. 2 is a side elevation of the embodiment of FIG. 1.

Turning now to the figures, an embodiment of a device for maintaining an open condition of a mouth of a bag in accordance with the invention, generally designated 10, is shown in FIGS. 1 and 2. Device 10 comprises a generally bar-shaped flexibly resilient body portion 1 of elongated dimension extending between opposed end portions 2. Advantageously, end portions 2 are configured with a width exceeding that of the body portion 1, as shown, to facilitate attachment to a bag and aid in stable ground support during use, as will be described in greater detail below. Holes 3 are optionally provided along at least a portion of a length of the body portion 1 to reduce material costs and to improve flexibility.

Figure 5A:
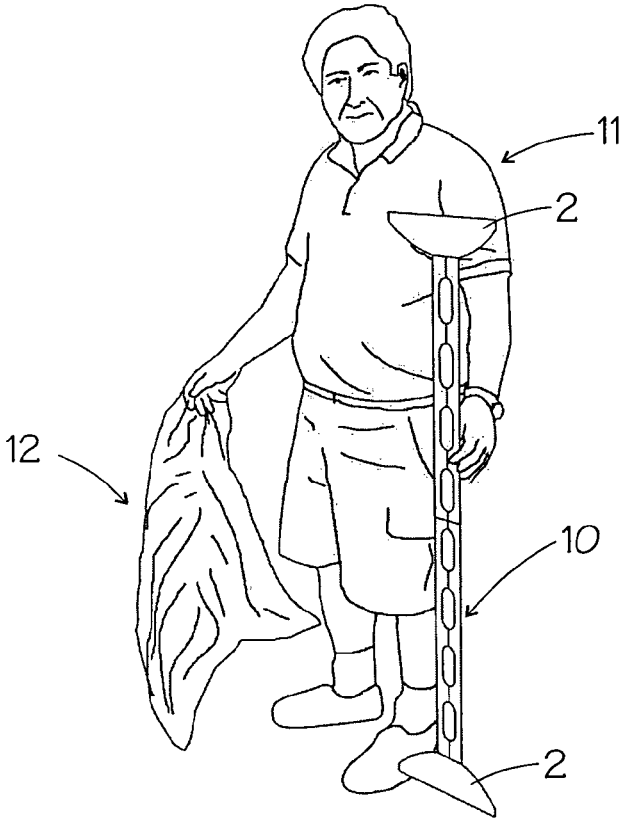
FIGS. 5*a*-5*e* are instructive views depicting steps of a method according to an embodiment of the invention employing the flexible member of the general design of FIGS. 1-4.
Figure 5B:
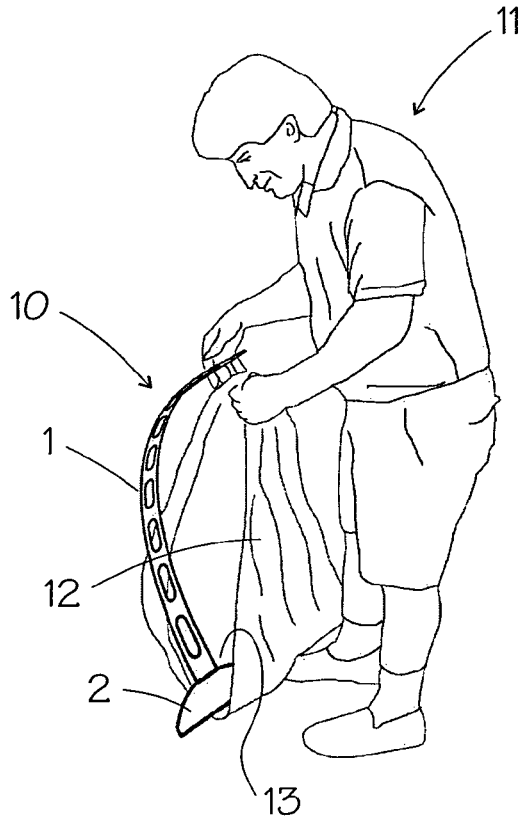
Figure 5C:
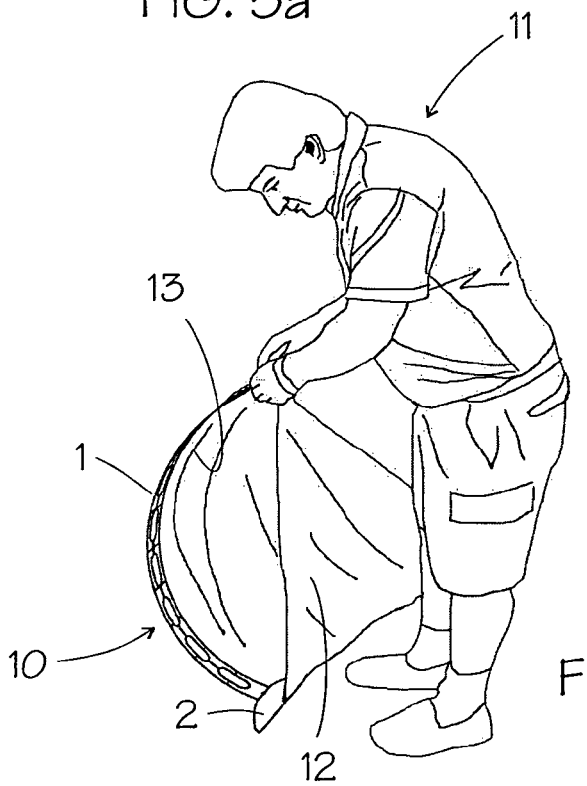
Figure 5D:
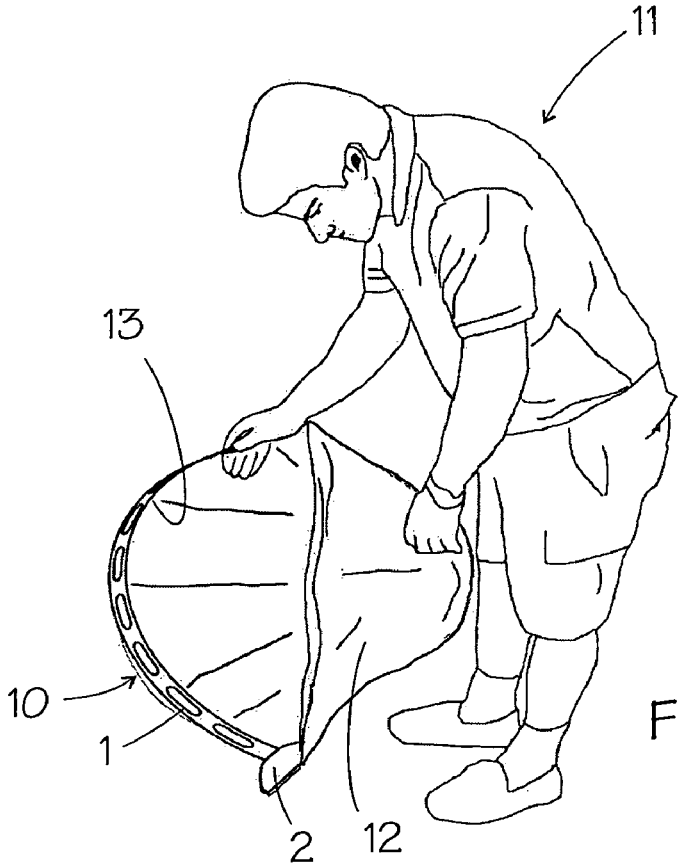
Figure 5E:
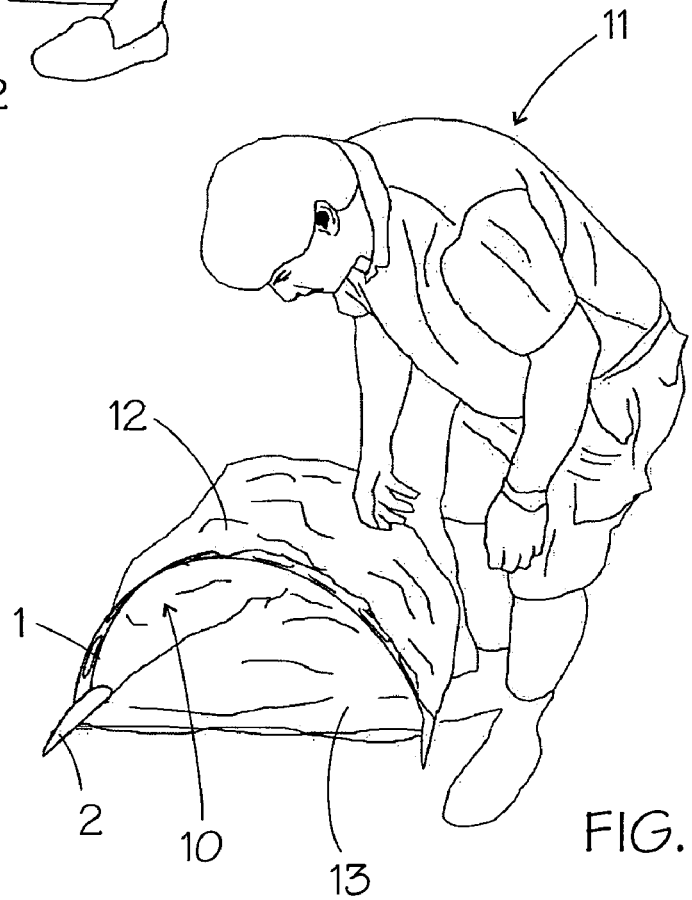

Turning now to FIGS. 5*a*-5*e*, a method of supporting a bag in an open state using the device as generally described in the foregoing embodiment will be detailed. As shown in FIG. 5*a*, a user 11 initially holds an refuse bag 12 in one hand, and the device 10 in another. The device 10 is shown in its unflexed state in which it advantageously assumes a overall planar configuration. To implement the method, the user 11 inserts one of the end portions 2 of the device 10 into a mouth opening 13 of the bag 12 and rests the end portion 2 against an interior of bag 12 adjacent an edge thereof defining the mouth opening 13, as shown in FIG. 5*b*. The device 10 is then arched, conveniently by applying gentle downward pressure in the longitudinal dimension of the flexibly resilient body portion 1. While maintaining an arcuate shape with continually applied downward pressure, the interior of bag 12 adjacent to the edge thereof defining the mouth opening 13 is guided by the user 11 along a convex side of the flexed body portion 1, as shown in FIG. 5*c*, so that the bag mouth opening 13 conformably follows the arcuate shape of the body portion 1. As shown in FIG. 5*d*, once the bag mouth opening has been made to follow the entire curved extent of the body portion 1, a remaining one of the end portions 2, which is at an opposed end of the end portion 2 which was first inserted into the bag mouth opening 13, is inserted into the mouth opening 13. Arching (flexing) pressure may then be released from the device 10, as the arcuate shape is retained by the inner dimensions of the bag 12, thereby preventing straightening of the device 10. Resilient tension of the device 10 against the interior circumference of the mouth opening 13 of the bag 12 fixedly secures the device 10 to the bag 12, which may then be placed, along with the installed device 10, on the ground, with the mouth opening 13 in a horizontally side-facing orientation, as shown in FIG. 5*e*.

As mentioned above, the widened end portions 2 serve to spread transfer of the spring forces to the bag 12 at each of the opposed ends of the device 10 over a greater area to reduce likelihood of excessive stretched deformation of the bag 12. Still further, by providing the end portions 2 with relative enlarged width, when the bag 12, together with the installed device 10, is placed on the ground with the mouth of the bag 12 in the sideways-facing orientation (as shown in FIG. 5*e*), the arcuately flexed body portion 1 of the device 10 is maintained in an upright orientation by virtue of stabilized ground support.

Figure 3:
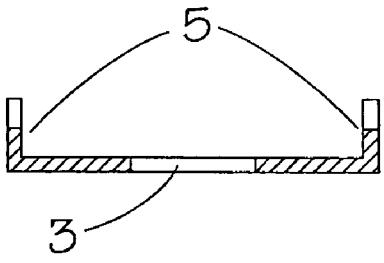
FIG. 3 is cross-sectional view taken along line 3-3 in FIG. 1.
Figure 4:
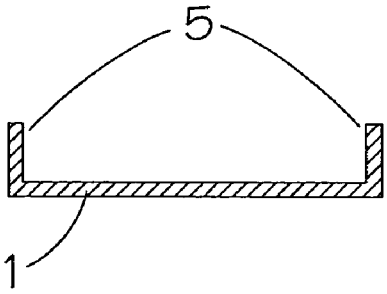
FIG. 4 is cross-sectional view taken along line 4-4 in FIG. 1.

Since the flexing force generated by bending the device 10 is the greatest in the middle thereof, the device 10 is advantageously constructed such that flexibility increases from the middle thereof to each of the opposed end portions 2, whereby the device 10 attains an arcuate shape more closely approximating a uniform curve when flexed. Returning now to FIGS. 1 and 2, and with further reference to FIGS. 3 and 4, as shown in the example of the device 10 depicted therein, such attribute is conveniently achieved by providing bilaterally disposed flanges 5 running orthogonally to a widened dimension of the flexible member, which extend along at least a length portion of the device 10. The flanges 5, as shown in FIGS. 1-4, have a height that increases as the middle of the device 10 is approached from either of its terminal ends, thereby increasing resiliency in the middle region of the device 10 (FIG. 4) and easing resiliency closer to the end portions 2 (FIG. 3).

While, as described above, flanges 5 have length-dependant height to provide varying resiliency over a length of the device 10, it is also contemplated that providing flanges of constant height provides independent advantage, by improving retained contact of a device in accordance with embodiment of the invention to a bag to which it is installed. In such instance, the device is flexed with the flanges positioned on the convexly curved side of the device, and when the bag is guided along the device, the flanges engage the inner circumference of the bag, thereby providing improved grip of the device therewith. Alternatively, rather than extending from only one side of the device, flanges can be provided on both sides of the device, thereby obviating the need for the user to flex the device in a particular direction and assuring that flanges will always be on the convex side of the flexed device, and will invariably engage the bag independent of the direction of flexing.

Figure 6:
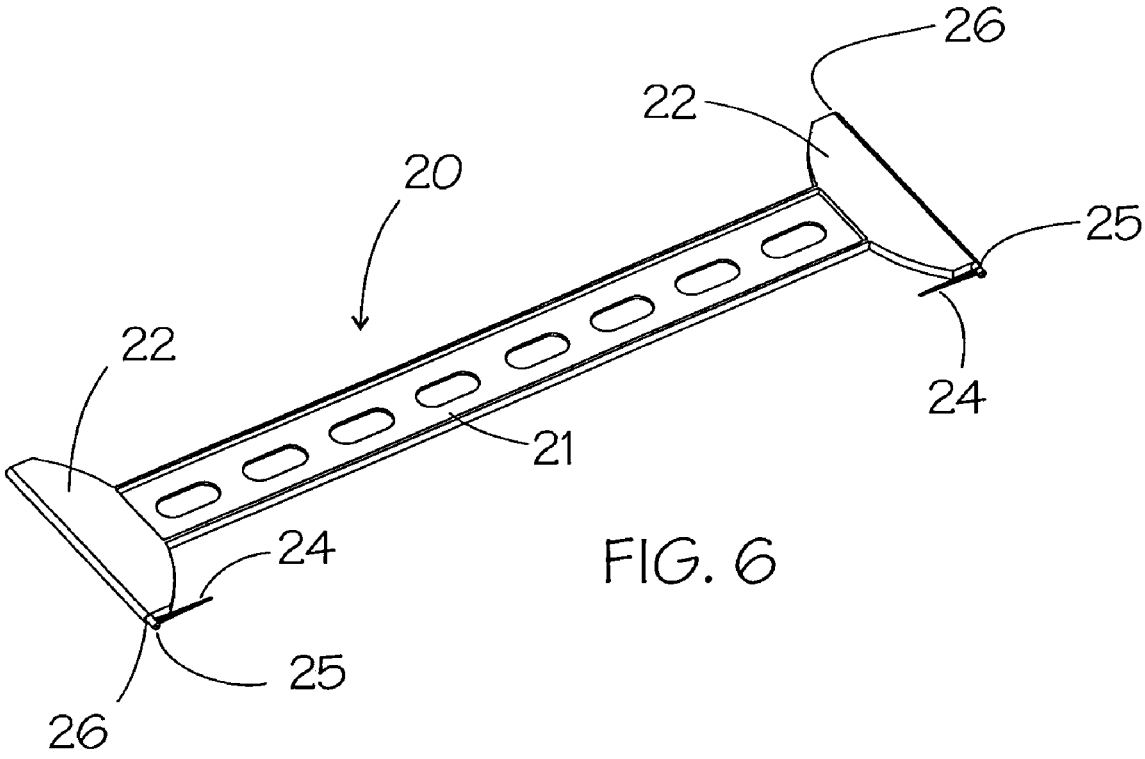
FIG. 6 is a perspective view of an advantageous embodiment including anchors for retaining the support member to the ground or to an upright support, depicted in an unflexed storage position.
Figure 7:
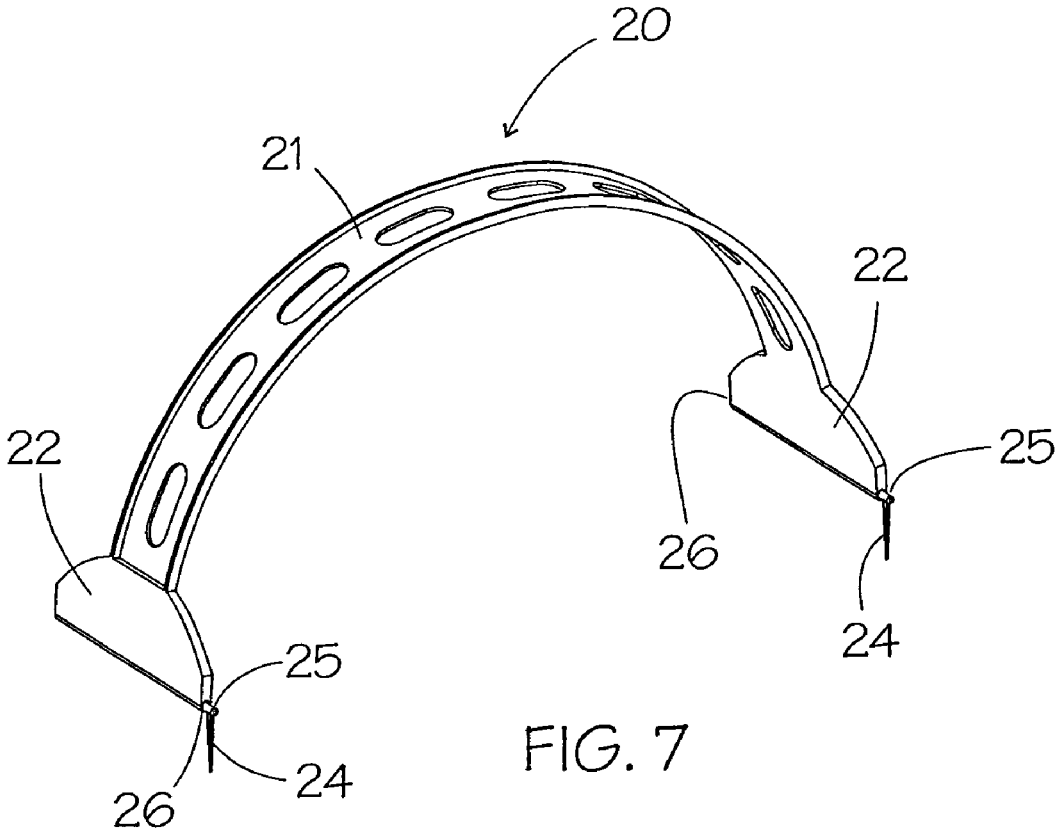
FIG. 7 is a perspective view of the embodiment of FIG. 6 in a flexed use position as installed in a bag (bag not shown for clarity) with the anchors oriented for ground penetration.
Figure 8:
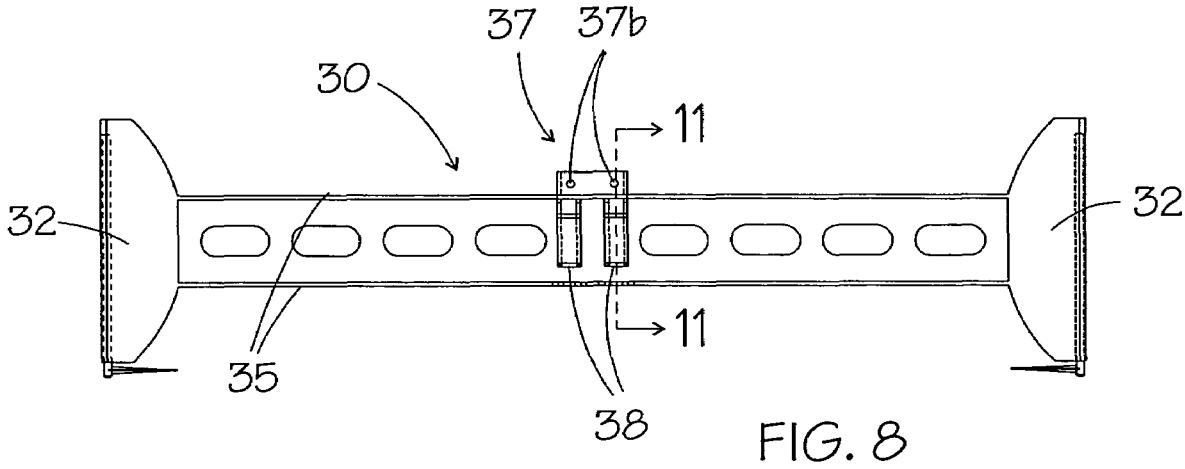
FIG. 8 is a plan view of another flexible bag support member in accordance with an embodiment of the invention including a mounting bracket for upright bag orientation.
Figure 9:
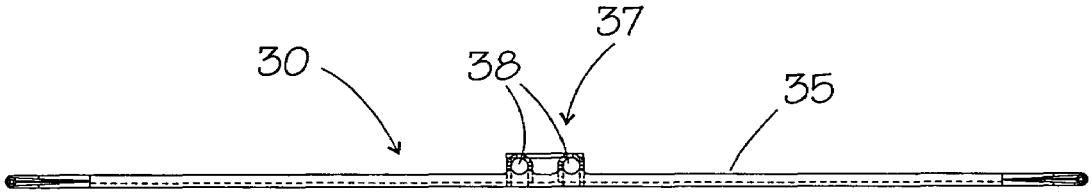
FIG. 9 is a side elevation of the embodiment of FIG. 8.
Figure 10:
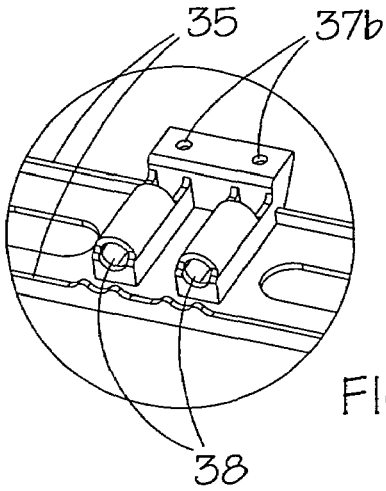
FIG. 10 is a perspective detail view of the mounting bracket of the embodiment of FIG. 8.
Figure 11:
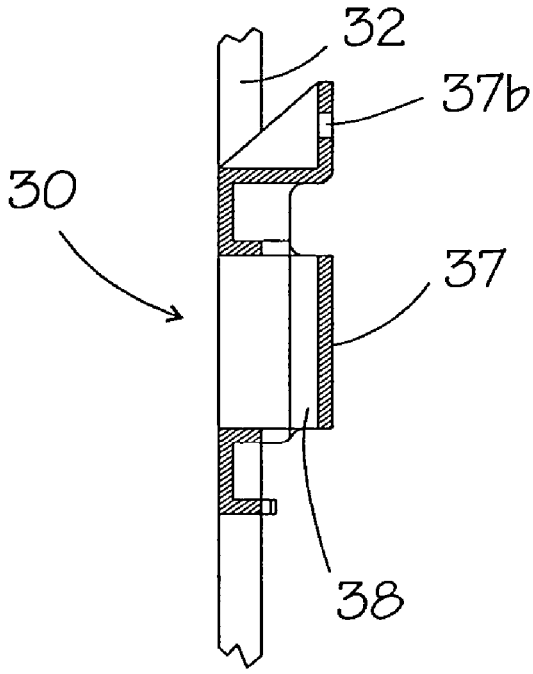
FIG. 11 is a cross-sectional view taken along line 11-11 of FIG. 8.

In addition to providing the widened end portions 2 for ground stability, as described above, it is deemed advantageous to further provide optional anchoring structure, for achieving additional stabilization and for inhibiting undesirable movement or shifting of the bag to be filled with respect to the ground or other supporting structure. Turning now to FIGS. 6 and 7, an embodiment of the device, designated 20 includes anchoring structure suited, in particular, for ground penetration during a filling operation. The anchoring structure is conveniently provided in the form of spikes 24 hingably (or pivotably) carried at end portions 22 of the support member in a suitable manner as generally practiced, to permit movement between storage and use oriented positions. In the depicted example, a shaft 25 extends orthogonally from a base of each of the spikes 24, and is captively and rotatably received within a receiving bore 26 formed at the end portions 22 of the device 20 extending crosswise to a longitudinal extent of a body portion 21 thereof. When positioned for use, as shown in FIG. 7 (the bag not being shown for greater clarity of illustration), the body portion 21 is flexed from a storage position, as shown in FIG. 6, into an arcuate shape and installed to a bag, in a manner as described above, with respect to the embodiment of FIGS. 1-4, in FIGS. 5*a*-5*e*. The shafts 25 are then rotated within the receiving bores 26 from a retracted storage position, shown in FIG. 6, to a position at which the spikes 24 are downward-facing when leading edges of the end portions 22 of the device 20 are made to contact the ground in a generally horizontal orientation, as shown in FIG. 7. It is noted that, while exemplified by pivotable, hinge-type mounting of spikes to the device 20, other suitable mounting practices for allowing selective movement of the anchoring structure (not necessarily in the specific form of spikes as shown) between storage and use orientation may be alternatively be employed, which may include (but not be limited to) other pivot mechanisms, a living hinge arrangement, or non-pivoting structure permitting detachment, reorientation and re-attachment of the anchor to the support member in alternate positions.

While described above as relating to a filling operation implemented generally by sweeping of material (debris and the like) into the bag with the mouth opening thereof facing to the side, the inventive method and device can also be used to load bags with a mouth opening thereof located in an upward-facing orientation. For such top loading operations, a suitably configured support device, for example the device 20 of the preceding embodiment, is installed to a bag and the combination of bag and device mounted to an upright support of suitable design by engagement with suitable cooperative means such that when the device 20 is arcuately flexed and installed to a bag, the device 20 lies along a generally horizontal plane.

Advantageously, specialized structure may be provided to facilitate mounting thereof to a support. Turning now to FIGS. 8-11, a device 30 is depicted which is of modified design made in accordance with the general guidelines described with reference to devices 10 and 20 previously described herein, and which is particularly well suited to vertical, in addition to, side-filling, orientations. Device 30 is the same in all regards as the basic design of devices 10 and 20, with the addition of a mounting bracket 37 adapted for engagement with cooperative structure carried on a support stand or other support (not shown in FIGS. 8-11), such as a vertical wall or upward facing support surface, the details of which are described in greater detail below, with reference to the figures which follow. As with the previous embodiments, the device 30 is shown to include optional widened end portions 32 at opposite ends thereof, and a pair of flanges 35, which serve the same purposes as those of the prior-described embodiments, and which have been included in the embodiment of FIG. 8 to clarify positional orientation of the mounting bracket 37 relative to the device 30 in the various figures.

As depicted, the mounting bracket 37 of device 30 includes a suitable structural configuration adapted to cooperatively couple with corresponding engaging structure carried on a support on which the device 30 is to be mountably supported, the details of which will be described below with particular reference to the various support structure embodiments. In the illustrated example of FIGS. 8-11, such configuration conveniently includes a pair of vertically-extending engagement holes 38 into which suitably shaped mounding rods (not shown) can be received for mounting to a support.

Figure 12:
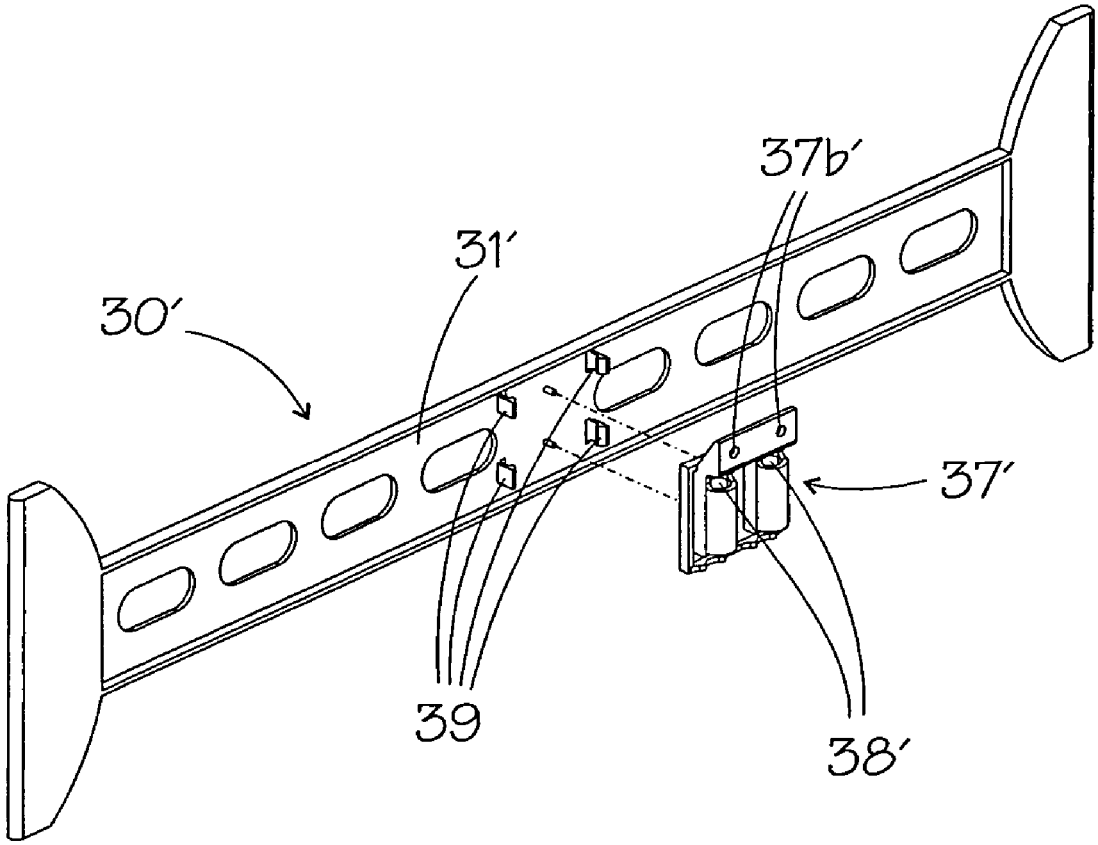
FIG. 12 is an exploded perspective view of another embodiment of a device according to the invention featuring a removable mounting bracket receivable thereto.

While the mounting bracket 37 of the embodiment of FIGS. 8-11 is integrally molded as part of the device 30, it will be understood that an alternative embodiment can include a mounting bracket which is receivable to the devices 10 and 20, for example, in snap-fit engagement or by other suitable means. One example of such a device, designated 30', having a removable mounting bracket is depicted in FIG. 12, in which the mounting bracket is generally designated 37'. Mounting bracket 37' includes a pair of engagement holes 38' of analogous design to engagement holes 38 of the embodiment of FIGS. 8-11, and is received in snap fit engagement with engagement flanges 39 advantageously in a central position of body portion 31', as shown.

Figure 13:
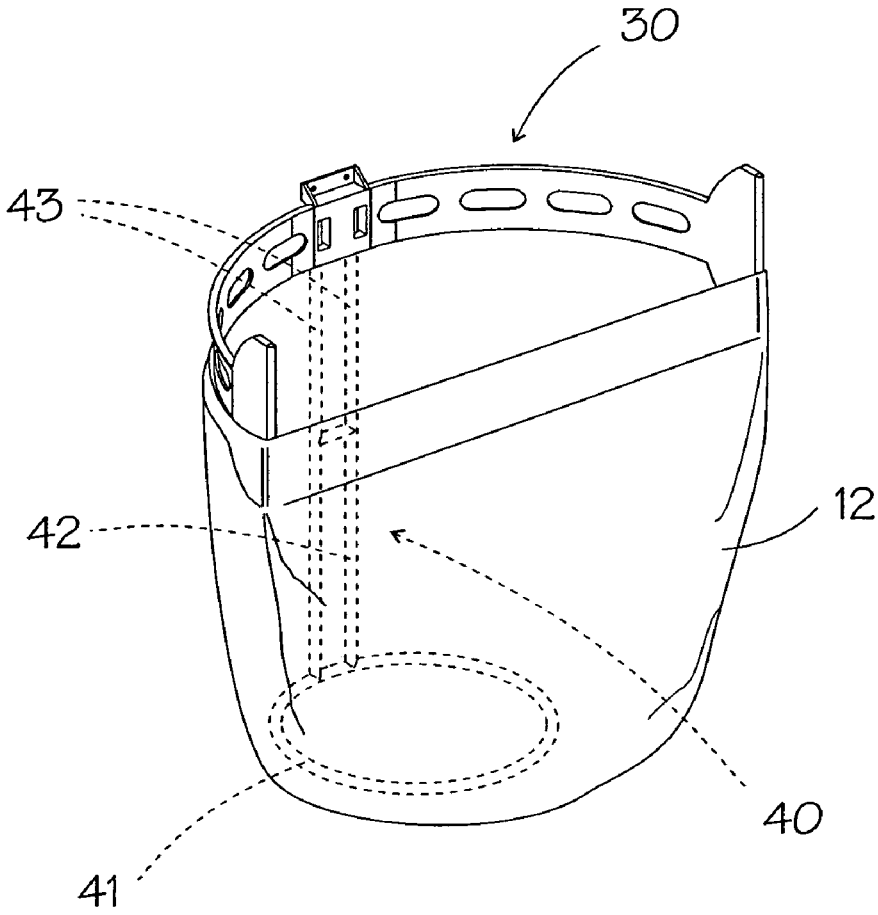
FIG. 13 is a perspective view of the flexible member in accordance with the embodiment of FIGS. 8-11 shown mounted to a free-standing support after being installed to a bag for top filling of the bag.
Figure 14:
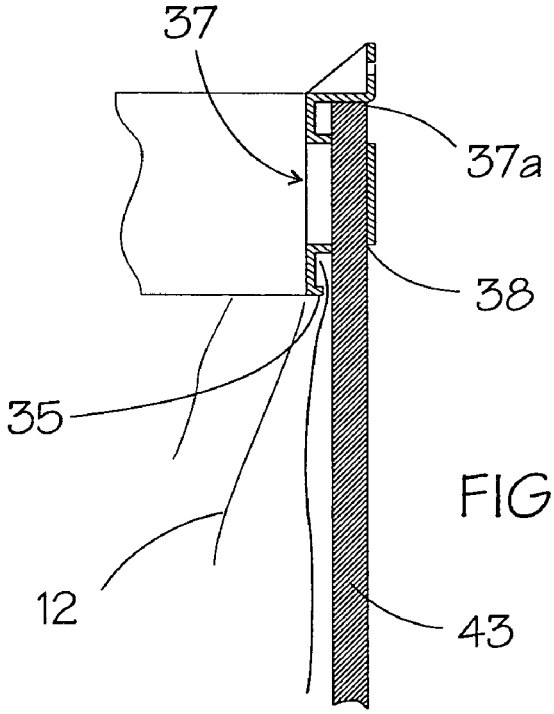
FIG. 14 is cross-sectional detail view illustrating the manner of engagement of the freestanding support with the mounting bracket.

Referring now to FIGS. 13 and 14, the device 30 (and device 30' by analogy) is shown mounted to a free-standing support 40 with bag 12 installed thereto. Support 40 includes a base 41 and an upright portion 42. Suitable cooperative mounting structure is provided, in the instant example, conveniently in the form of a pair of rod portions 43 configured for reception within engagement holes 38. A top wall 37*a* of the mounting bracket 37 acts as a stop for the ends of rod portions 43 when received in the engagement holes 38. As depicted in FIG. 14, bag 12 is advantageously retained in an installed state by pressure contact with one of the pair of flanges 35 of device 30 running along at least a length portion thereof.

In the above described embodiments, support 30 (and 30') is mounted on a free standing support 40 (40'). However, advantageously, mounting bracket 37 (37') additionally (or alternatively) includes a structural feature facilitating vertically-positioned mounting to a wall, table-top or like structure. Returning to FIGS. 8-12, mounting bracket 37 includes mounting holes 37*b* (and similarly mounting bracket 37' includes mounting holes 37*b*') for attachment thereof to a wall or other vertical surface by screws, nails or the like. It will be further understood that similar holes could be provided in a vertical orientation for attachment to a horizontal surface, such as, for example, a peripheral edge of a tabletop, as desired.

The device according to embodiment of the invention may be made in a form that can be stored in a compacted envelope. For example, the embodiments for which the following descriptions apply, allow the device to be oriented alternately in respective storage and use conditions.

Figure 15:
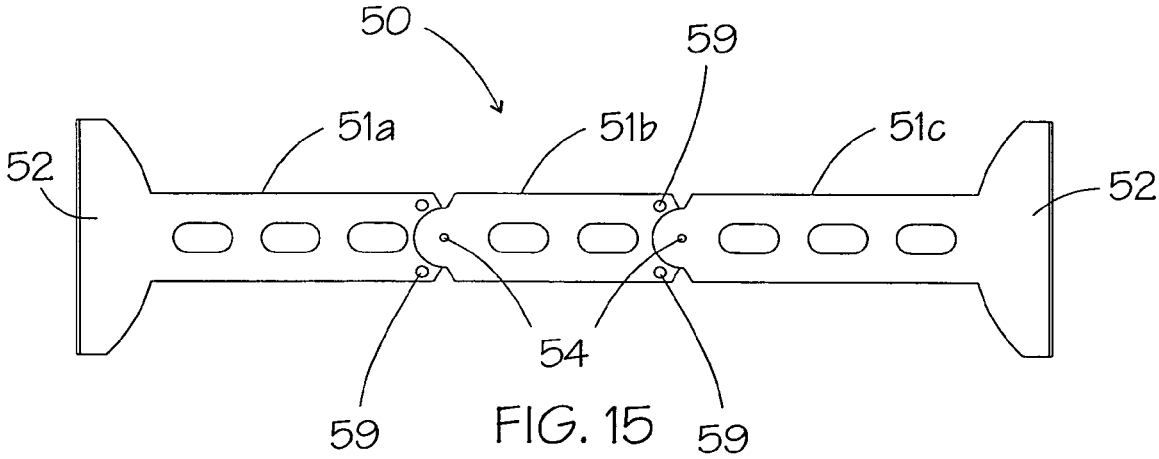
FIG. 15 is plan view of a collapsible embodiment in accordance with the invention employing folding structure shown in an expanded, use-oriented state.
Figure 16:
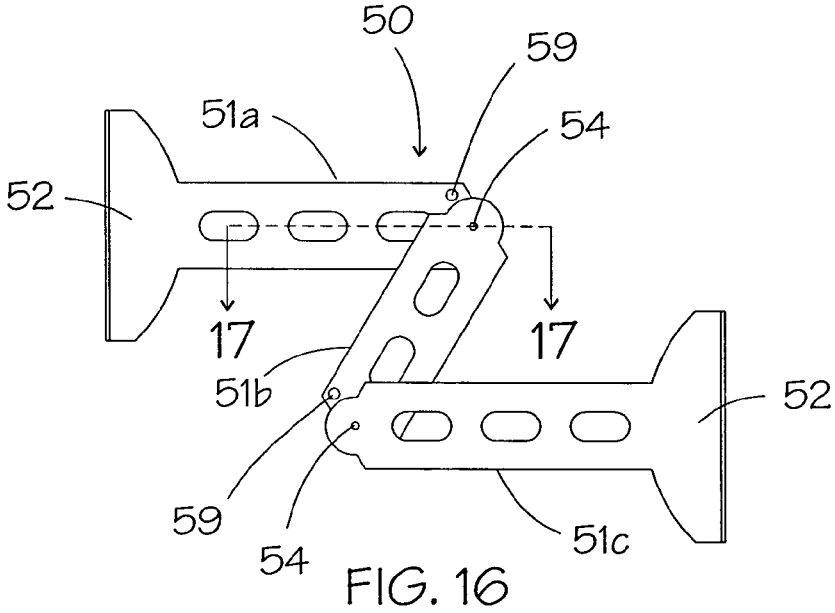
FIG. 16 is plan view of the collapsible embodiment of FIG. 15 shown in a partially folded storage state.
Figure 17:
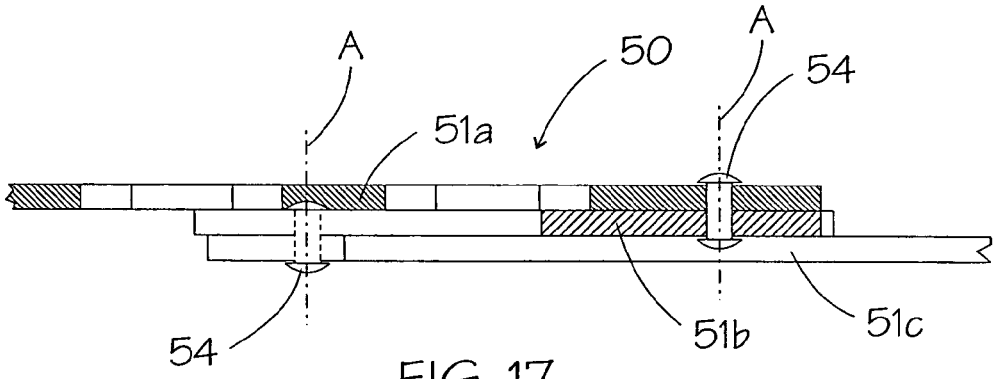
FIG. 17 is cross-sectional view taken along line 17-17 of FIG. 16.

Turning to FIGS. 15-17, a device, generally designated 50, utilizes folding structure including at least two segments (three segments 51*a*, 51*b* and 51*c* in the depicted example) pivotable about one or more axes A (two shown in the depicted example) that are arranged crosswise to a plane coinciding with the flattened extent of device 50 and codirectional with a bending direction during use. Segments 51*a*, 51*b*, 51*c* are pivotably joined by suitable means, conveniently by rivets 54. When positioned for use, as shown in FIG. 15, segments 51*a*, 51*b*, 51*c* are arranged along a straight path, and are advantageously retained in such position by suitable means, for example raised structural features 59, that inhibit reorientation. Such structural details for retainment are well known in the art, and therefore further description will not be provided as considered unnecessary. Segments 51*a* and 51*c* in end positions advantageously include widened end portions 52 analogous in structure and function with those of the aforementioned embodiments. When device 50 is stored between use, segments 51*a*, 51*b*, 51*c* are pivoted about rivets 54, as shown in FIG. 16, and overlay one another as shown in FIG. 17, for compact storage.

Figure 18:
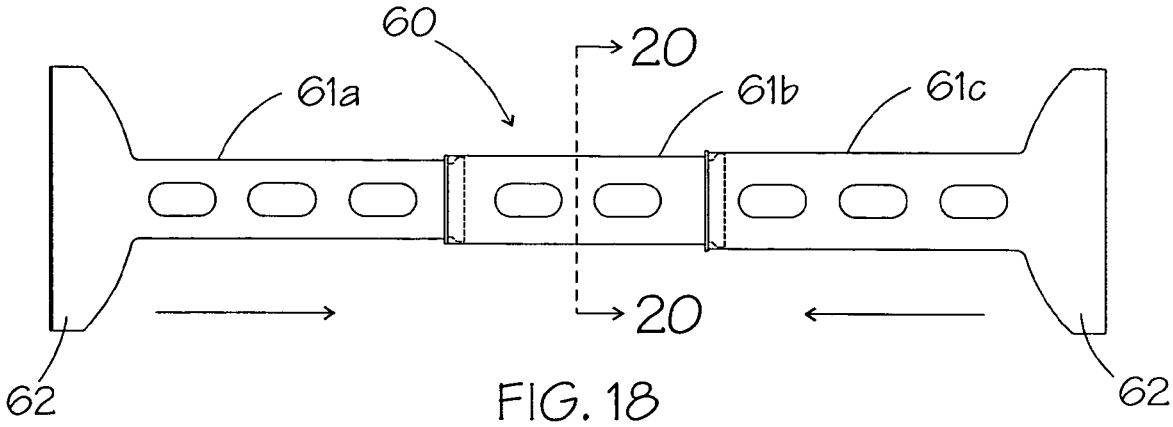
FIG. 18 is plan view of a collapsible embodiment in accordance with the invention employing telescoping structure shown in an expanded, use-oriented state.
Figure 19:
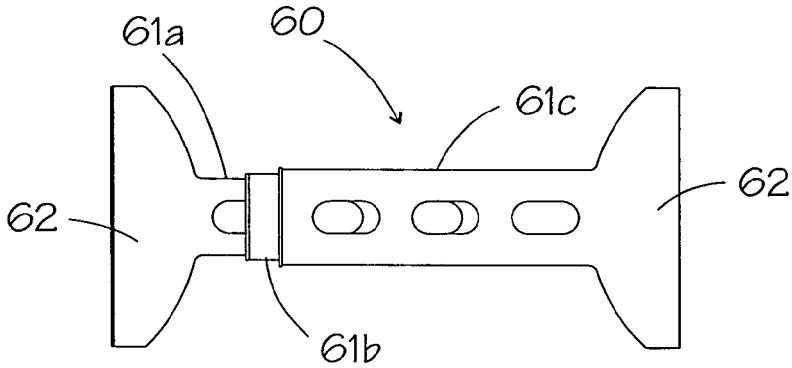
FIG. 19 is plan view of the collapsible embodiment of FIG. 18 shown in a collapsed storage state.
Figure 20:
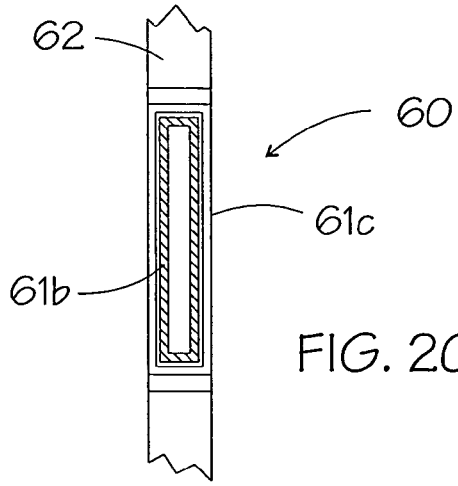
FIG. 20 is cross-sectional view taken along line 20-20 of FIG. 18.

Referring now to FIGS. 18-20, a device 60 incorporates two or more (three shown) telescoping segments 61*a*, 61*b*, 61*c* which allow the device 60 to be slidably collapsed from a use orientation (FIG. 18) to a compact storage position (FIG. 19). As in the previously described embodiments widened end portions 62 provide analogous advantage.

Figure 21:
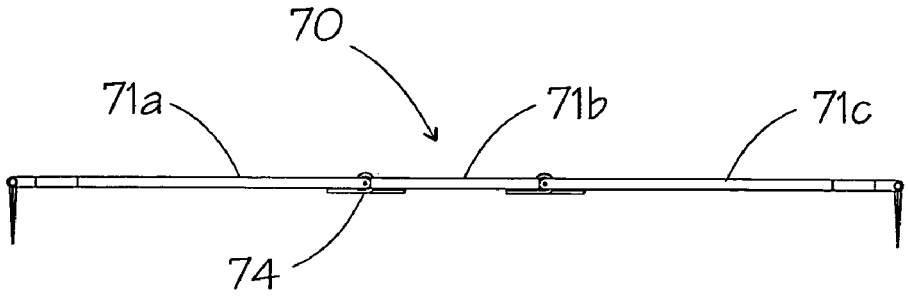
FIG. 21 is a side elevation of another embodiment of a device according to the invention utilizing a biased folding structure shown in a flat, storage state.
Figure 22:
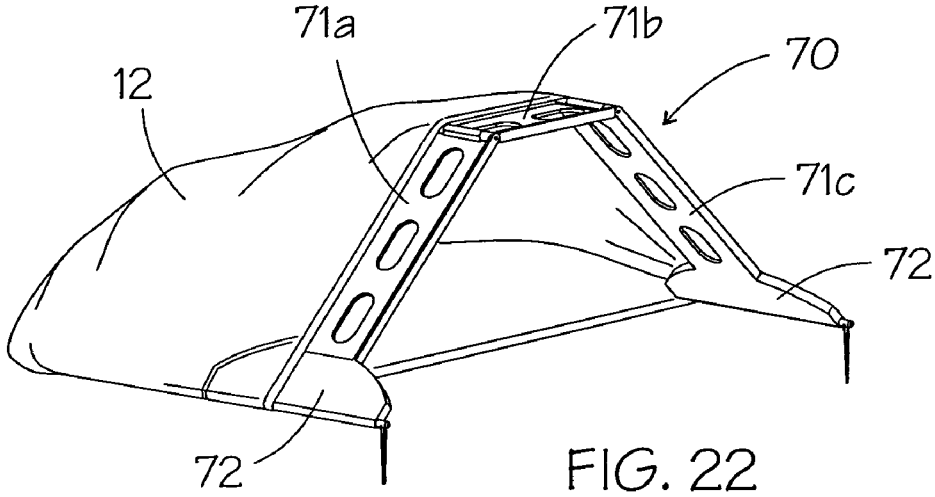
FIG. 22 is a side elevation of the embodiment of FIG. 21 shown in side-oriented, ground-supported use with a bag installed.
Figure 23:
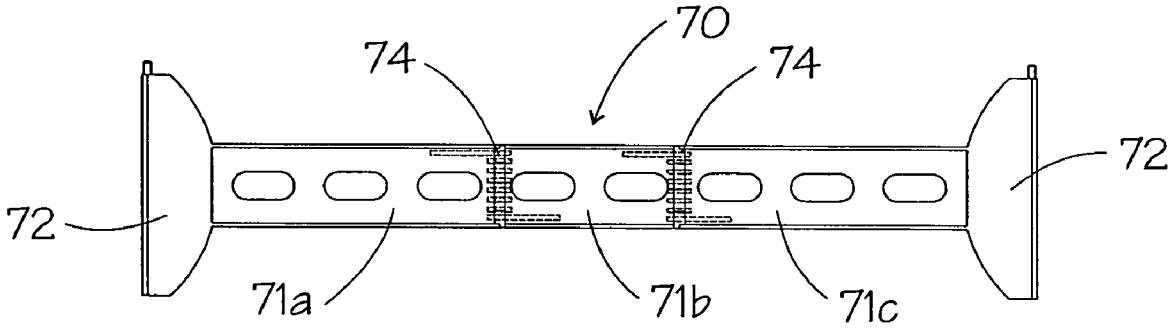
FIG. 23 is a plan view of the device as shown in FIGS. 21 and 22.

As previously mentioned, while each of the above embodiments provide a nonlinear path defined by a smooth curve along which the bag is guided for support, the invention as contemplated can broadly embrace also a non-linear path defined by an angular configuration. For example, as depicted in FIGS. 21-23, a device 70 is comprised of at least two segments (three segments 71*a*, 71*b*, 71*c* being depicted in the example) which are hingably interconnected and biased in a flattened condition as shown in FIG. 21, for example by springs 74. During use, the segments are angled with respect to one another, as shown in FIG. 22, and the bag 12 made to follow the angled path defined by the device 70. The biasing exerted by the springs 74 retains the device 70 to the bag 12 in a manner analogous with a device having resilient characteristics described above herein.

In accordance with a further advantageous embodiment of the invention, the device for implementing the method disclosed herein and a bag particularly suited for use with such device are provided in combination. In accordance with such embodiment, it is contemplated that the combination of the bag and holding device can thus be supplied to a consumer at time of purchase for later mutual use at a time and place as desired. Advantageously, such device, constructed in accordance with the guidelines as generally described herein, could be supplied for each of a plurality of bags, and which presumably would be intended for one time use with the particular bag being filled, such that once filled, the bag, along with the device, would be disposed of together. Alternatively a device supplied with the bags in combination therewith could be used more than once for two or more bag filling operations.

Figure 24:
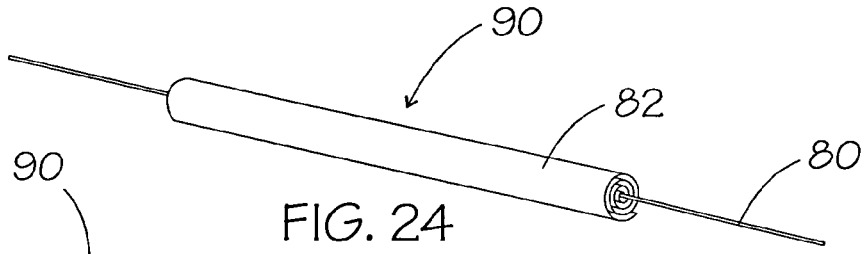
FIG. 24 is a perspective view of an embodiment directed to a bag/device combination prior to use.
Figure 25:
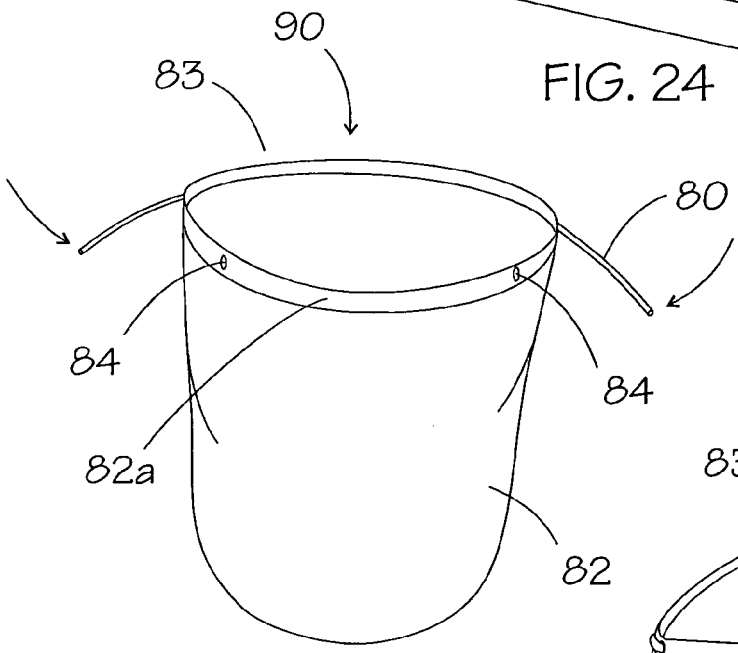
FIG. 25 is a perspective view of the embodiment of FIG. 24 shown prior to use-oriented assembly.
Figure 26:
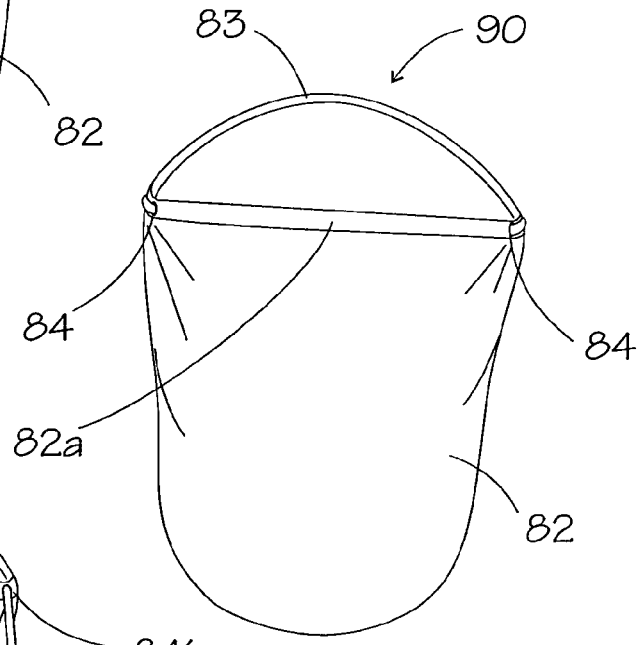
FIG. 26 is a perspective view of the embodiment of FIGS. 24 and 25 shown in the assembled, use-oriented state.

Turning now to FIGS. 24-26, an example of such combination is depicted. A bag/device combination is generally designated 90, and comprises a device 80 about which a bag 82, which is advantageously of special construction, is conveniently rolled, as shown in FIG. 24. Bag 82 could alternatively be folded, etc., to achieve a convenient compact shape for consumer packaging. Device 80 can take the form of any of the foregoing embodiments, however, in the depicted example, it is a simple bendable wire of circular cross-section. The device is advantageously held to the bag 82 by suitable means such that the bag/device combination 90 can be suppled as a single unit. In the depicted example, this is accomplished by providing the bag 82 with a hem 82*a* formed at the opening of the bag 82 defining a conduit in which a length portion of the device 80 is captively maintainable, with end portions of the device extending outward of the hem 82*a*. Hem 82*a* further includes a pair of engagement holes 84 suitably positioned circumferentially of the bag 82, formed conveniently in the hem 82*a*, to allow the ends of the device to be inserted therein, by bending the device 80 in the direction of the arrows in FIG. 25, to arrive at a use condition shown in FIG. 26, with the ends of the device 80 retained therein. Because the device 80 is retained to the bag by the hem 82*a*, the wire comprising the device can be made of a material which either exhibits resiliency tending to return to a straight condition or one which is bendable to retain a shape into which it is bent by application of force.

It will be understood that hem 82*a* can be formed external of the remainder of the bag 82, as depicted, or alternatively, internal thereof. In addition, since hem 82*a* serves a function of retaining the device 80 to the bag 82, hem 82*a* need not be circumferentially continuous, and can simply comprise instead, for example, a series of belt loops, formed interior or exterior of the bag 82, through which the device can be threaded, much in the manner of a belt.

Figure 27:
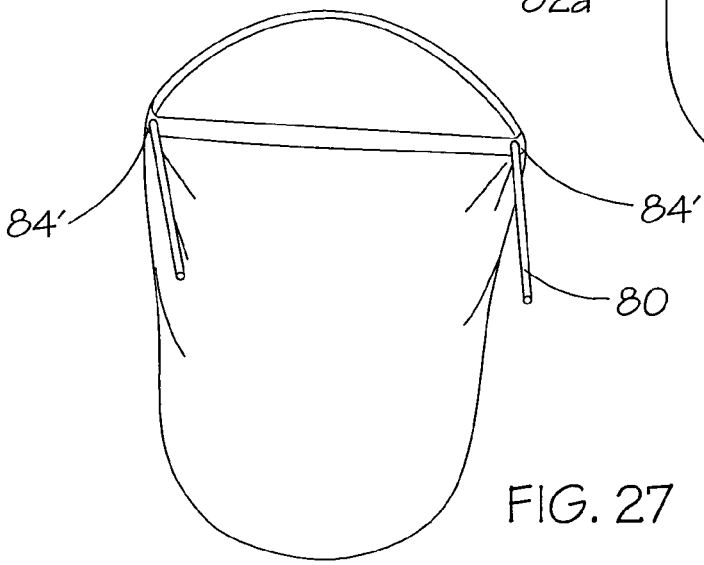
FIG. 27 is a perspective assembled view of an alternative embodiment of the bag/device combination of FIGS. 24-26.

While, in accordance with the depicted example of FIGS. 24-26, the ends of the device are simply tucked into the engagement holes 84, it is noted that alternatively, the ends of the device 80 could be made to penetrate through the hem 82*a* from an interior of the conduit defined thereby through holes 84' formed in a suitably configured bag 82' near the top bag opening thereof, as shown in FIG. 27. As such, the ends of the device 80 could serve an anchoring function analogous to that provided by the spikes 24 shown and described with reference to FIGS. 6 and 7.

As exemplified by the embodiment of FIG. 27, by selectively circumferentially positioning the holes 84' such that the device 80 extends over more that half of the circumference of the bag before exiting through the holes 84', an open condition of the bag is maintained by forces applied thereto by the device 80 itself. As further exemplified, it will be further understood that there is no requirement that the device and method according to the invention rely on internal support of the bag by a device inserted therein, so long the bag is supported in some suitable manner by a structure retained to the bag which causes at least a portion of the bag circumference to follow a non-linear path forming a retained bag mouth opening. Concretely, for example, in accordance with the depicted example of FIG. 27, the device is retained in a position external of the bag, within the externally formed hem 82*a*.

It is noted that, in the majority of the preferred embodiments described herein with reference to the figures, a device made in accordance with the invention includes terminal ends that contact respective points along the interior circumference of the bag. In such cases, an overall length of such device is advantageously less than a total bag circumference, such that the ends of the device are spaced apart from one another inside the bag when installed. However, as will be recognized, for example, from the disclosure relating to the preceding embodiment of FIG. 27, the invention is not intended to be so limited, and the device length can conceivably exceed a bag circumference, for example, either by having end portions which extend through the bag to the outside (as in FIG. 27), or alternatively by including portions thereof that circumferentially overlap internal of the bag circumference when installed to the bag.

While the invention is described with particularly well-suited application to relatively larger dimensioned bags, such as those used typically in connection with lawn and construction cleanup, the invention is also contemplated as finding utility in applications involving smaller bags, for example, of the type routinely used in maintaining cleanliness of the home or office.

It is further noted that the generally bar-shaped configuration of a device for implementing the method in accordance with the invention, while considered advantageous, is not intended to be construed as limiting of the broad concept deemed embraced by the inventive concept disclosed herein. For example, a device of oval, circular or other suitable cross-section (such as the circular cross-section configuration of the device shown with reference to the combination bag/support embodiment of FIGS. 24-26), rather than the flattened rectangular cross-section of the generally bar-shaped examples disclosed with reference to the remaining figures, is also acceptable to practice of the invention and considered within the scope thereof.

In addition, while it is considered advantageous to utilize an elongated member having at least some degree of resiliency, as described above in connection with the various illustrated embodiments, such characteristic is not considered essential to the invention as contemplated. In this regard, it is entirely possible within the contemplated scope of the invention to use a member which exhibits essentially no degree of resiliency. In such case, a suitable device would nevertheless, in general accordance with the disclosure herein, be capable of assuming and retaining one or more shapes in the direction of an elongated dimensional component extending between respective opposed free ends thereof each defining a particular non-linear path along which the circumference of the bag can be made to follow. A total length of such non-linear path, as disclosed above, and which could possibly include linear portions, would also be greater than half of the circumference of the bag opening, such that at least a circumferential segment portion of the bag is maintainable in a position roughly corresponding to the non-linear path, and a remainder (if any) of the circumference left to extend (advantageously along a straight path substantially free of play) in an unsupported manner between the free ends of the device, spaced apart from the portion guided along the non-linear path (where the device length is less than a total circumference of the bag and is received entirely internal of the bag), thereby defining the maintained opening through which raked leaves and other refuse can be introduced into the bag when the device is installed thereto. Once the bag has been made to follow the non-linear path defined along the elongated dimensional component of the device, the bag would then be retained to the device by suitable means provided in lieu of the absent outwardly-acting resilient forces otherwise present in an alternative device utilizing resiliently biased characteristics, described with reference to the preceding embodiments. For example, the hem 82*a* of the embodiment depicted in FIGS. 25-26, acts as one such suitable means for retaining the bag to the device.

It is additionally noted that, while the device embodiments described herein advantageously do not include any connecting structure between terminal ends thereof, it is deemed acceptable within the contemplated scope of the invention to have a string, rope, length-adjustable or compressible member, or the like, which bridges the open space between terminal ends of a device in accordance with the disclosure herein, and which interconnects same. Such structure, while permitting adjustment of a degree of bowing of the device, would advantageously not act to restrict an increase in the degree bowing, for example where the device would have to be adjusted for installation to a bag of smaller circumference.

It will be further understood that, while the illustrated embodiments each depict a device installed to a bag as being oriented for ground supported use with the portion of the bag circumference which extends in a substantially unsupported manner between terminal ends of the device facing the ground (see for example, FIGS. 5*e*, 7 and 22), no such requirement is contemplated. For example, in the embodiment of FIG. 22, one of the support segments 71*a*, 71*b*, 71*c* could instead be oriented for contacted ground support, if so desired.

Lastly, while those of the device examples described above that rely at least in part upon resiliency or biasing use a counter-resistance of the bag circumference to maintain the arched state of the device, it is also contemplated that other means alternative or supplemental to the bag structure can be employed to maintain the nonlinear state of the device during use. For example, penetration of the ground with ends of the device 80 when using the embodiment of FIG. 27 can serve to retain a bowed state of the device, irrespective of whether the device circumscribes more that half of the bag circumference.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A method of maintaining a bag in an open mouth condition for filling with material, the bag having an inner circumference and a filling extent which extends from a mouth opening to a closed end thereof, the method comprising:

inserting an elongated object having resilient characteristics over at least a length portion thereof into the mouth opening of the bag;

flexing the elongated object lengthwise to create a bend over said at least a length portion of the elongated object, at least a portion of said at least a length portion of the elongated object being located in a central section of the elongated object;

guiding a circumferential portion of said inner circumference of the bag to conformably follow a path defined by the elongated object from a one end of said elongated object to an opposite end thereof positioning said elongated object in the bag such that only a minor portion of said filling extent overlaps said elongated object in a width direction thereof and a major portion of said filling extent of the bag remains free of contact with the elongated object; and releasing flexing tension on the elongated object whereby the elongated object is retained in a position adjacent to the mouth opening of the bag.

2. A method according to claim 1, further comprising:

placing the bag with the elongated object installed therein on a generally horizontal support surface with said one end and said opposite end of the elongated member supported by the support surface; and orienting the bend over said at least a length portion generally vertically above the support surface such that the mouth opening of the bag is facing horizontally sideways.

3. A method according to claim 1, wherein said elongated object is comprised of at least two individual elements.

4. A method according to claim 1, wherein said elongated object is a single contiguous member.

5. A method according to claim 1, wherein said at least a length portion having resilient characteristics extends substantially over a length of said elongated object.

6. A method of filing a bag with material, the bag having an inner circumference and a filling extent which extends from a mouth opening to a closed end thereof, the method comprising:

providing guidable support to a portion of a circumference of the bag along a path including a non-linear portion, said path being longer than half of the circumference of the bag;

applying said guidable support only to a minor portion of said filling extent such that a major portion of said filling extent of the bag remains in an unsupported condition;

extending a remaining portion of the circumference of the bag in a substantially unsupported manner between opposed ends of the path such that a gap is formed between said non-linear path along which said portion is guided and said remaining portion of said circumference of said bag; and introducing the material into the bag via said gap while said bag is oriented with said remaining portion of the circumference of said bag facing a support surface for said bag.

7. A method according to claim 6, further comprising mounting the bag in a supportably guided condition to a support.

8. A method according to claim 7, wherein said support is a freestanding structure and said gap faces upward.

9. A method according to claim 7, wherein said support is the ground and said gap faces in a horizontally sideways directions.

10. A method according to claim 6, wherein said non-linear portion extends substantially over a length of said path.

11. A method of retaining an open condition of a bag, the bag having an inner circumference and a filling extent which extends from a mouth opening to a closed end thereof, the method comprising:

guiding a portion of a circumference of the bag along a non-linear path defined by at least a portion of a length of a support, at least a portion of a central section of said support including at least a portion of said non-linear path, the length of said support being greater than half of the circumference of the bag such that a remaining portion of the circumference of the bag extends in a unsupported manner along an extent thereof between opposed ends of the support, a gap being formed between the portion of the bag guided along said non-linear path and said remaining portion of said circumference of said bag;

retaining said bag to said support in a manner maintaining guided correspondence between said portion and said non-linear path; and positioning said support in the bag such that only a minor portion of said filling extent is in said guided correspondence with said support in a width direction of said support and a major portion of said filling extent of the bag remains free of contact with the support.

12. A method according to claim 11, wherein said non-linear path extends substantially over said length of said support.

13. A method of filling a bag with material while maintaining an open mouth condition of the bag, the bag having an inner circumference and a filling extent which extends from a mouth opening to a closed end thereof, the method comprising:

inserting an elongated object having resilient characteristics over at least a length portion thereof into the mouth opening of the bag;

flexing the elongated object lengthwise to create a bend over said at least a length portion of the elongated object;

guiding a circumferential portion of the inner circumference of the bag to conformably follow a path defined by the elongated object from a one end of said elongated object to an opposite end thereof;

positioning said elongated object in the bag such that only a minor portion of said filling extent overlaps said elongated object in a width direction thereof and a major portion of said filling extent of the bag remains free of contact with the elongated object;

releasing flexing tension on the elongated object whereby the elongated object is retained in a position adjacent to the mouth opening of the bag; and orienting the bag, with the elongated object retained thereto, such that said one end and said opposite end of the elongated object are directed towards a support surface for said bag.

* * * * *